US005966570A

United States Patent [19]

Till et al.

[11] Patent Number: 5,966,570

[45] Date of Patent: Oct. 12, 1999

[54] IMAGE-WISE TONER LAYER CHARGING FOR IMAGE DEVELOPMENT

[75] Inventors: Henry R. Till, East Rochester; Stewart W. Volkers, Ontario, both of N.Y.

[73] Assignee: Xerox Corporation, Stamford, Conn.

[21] Appl. No.: 09/004,629

[22] Filed: Jan. 8, 1998

[51] Int. Cl.[6] ..... G03G 15/00

[52] U.S. Cl. ..... 399/133; 399/237; 399/296; 430/117; 430/120

[58] Field of Search ..... 399/130, 133, 399/135, 136, 153, 237, 239, 240, 247, 296; 430/117, 120, 126; 347/120, 151, 158

[56] References Cited

U.S. PATENT DOCUMENTS

| | | | |
|---|---|---|---|
| 3,519,818 | 7/1970 | Bean | 430/126 |
| 3,661,454 | 5/1972 | Clark | 399/133 |
| 3,849,126 | 11/1974 | Cantarano | 430/126 |
| 3,853,397 | 12/1974 | Cantarano | 399/152 |
| 3,890,040 | 6/1975 | Schmidlin | 399/133 |
| 4,402,000 | 8/1983 | Fabel et al. | 347/151 X |
| 4,504,138 | 3/1985 | Kuehnle et al. | 399/240 |
| 4,838,940 | 6/1989 | Kan et al. | 347/158 X |
| 4,883,018 | 11/1989 | Sagiv | 399/247 X |
| 5,387,760 | 2/1995 | Miyazawa | 399/239 |
| 5,436,706 | 7/1995 | Landa et al. | 399/238 |
| 5,619,313 | 4/1997 | Domoto et al. | 399/233 |
| 5,650,253 | 7/1997 | Baker et al. | 430/126 X |
| 5,737,678 | 4/1998 | Volkers et al. | 399/237 X |
| 5,745,144 | 4/1998 | Christy | 347/151 |
| 5,826,147 | 10/1998 | Liu et al. | 399/237 |
| 5,883,656 | 3/1999 | Christy | 347/151 |

*Primary Examiner*—William Royer
*Assistant Examiner*—Sophia S. Chen
*Attorney, Agent, or Firm*—Denis A. Robitaille

[57] ABSTRACT

An image development method and apparatus, wherein a support member is provided with a layer of marking material thereon, and an electrostatic latent image is created in the layer of marking material via image-wise charging of the layer of marking material. A selectively controllable charging device for directing a charge stream toward the support member having the layer of marking material coated thereon. The image-wise charge stream corresponds to the latent image, which, in turn, leads to image-wise charging of the toner layer, such that the toner layer itself becomes the latent image carrier. The latent image carrying toner layer is subsequently developed and transferred to a copy substrate to produce an output document.

79 Claims, 5 Drawing Sheets

IMAGE-WISE TONER LAYER CHARGING FOR IMAGE DEVELOPMENT

Figure 1:
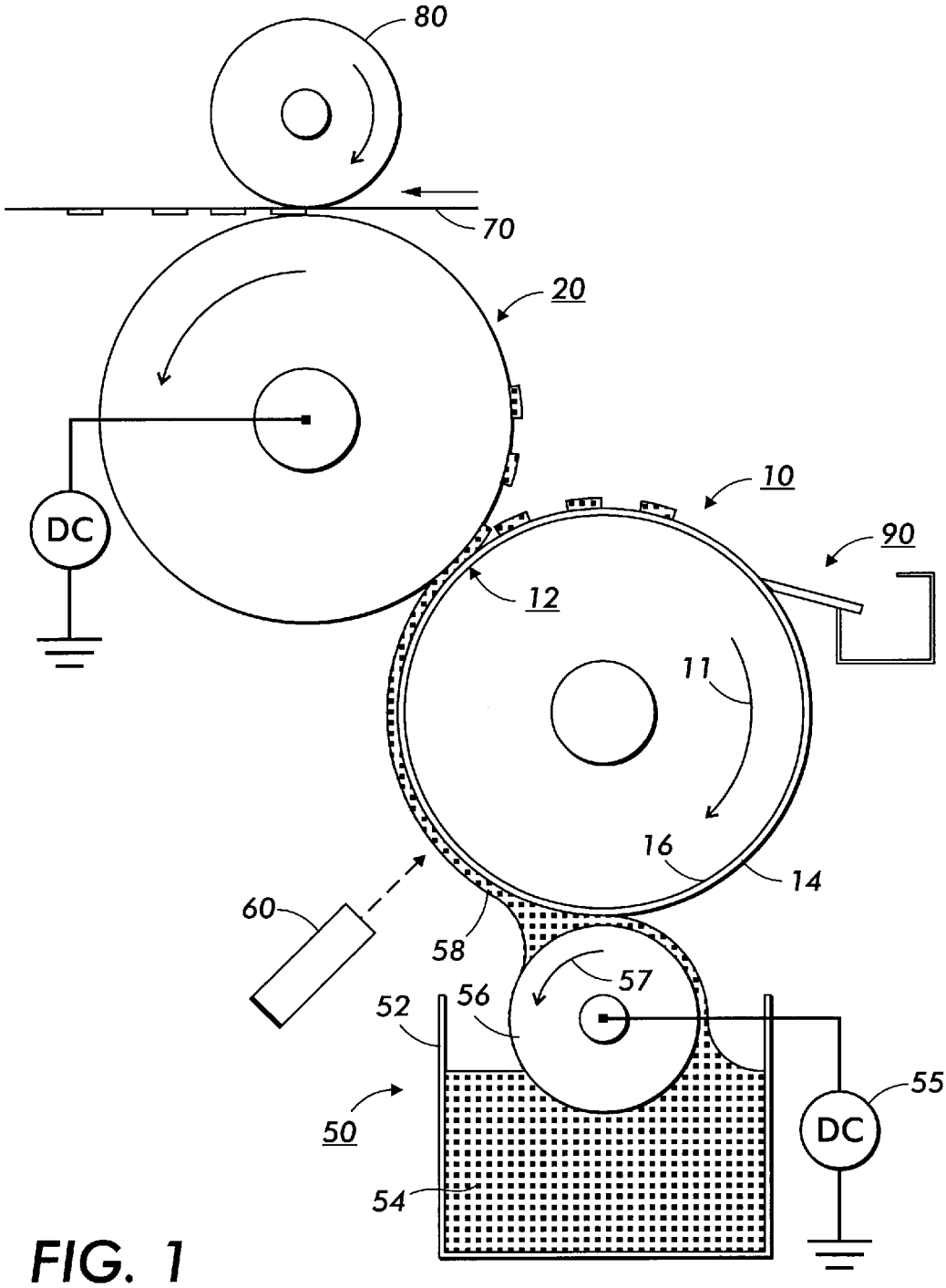

This invention relates generally to electrostatic latent image formation and development, and, more particularly, concerns an apparatus and method for forming an electrostatic latent image in a layer of developing material comprising toner or marking particles by selectively applying charge potential to the layer for creating an image-wise charged toner layer capable of being developed by selectively separating and transferring portions of the toner layer in correspondence with the latent image imbedded therein to produce a developed output image.

Typical processes for electrostatographic copying and printing are initiated by selectively charging and/or discharging a charge receptive imaging member in accordance with an original input document or an imaging signal, thereby generating an electrostatic latent image on the imaging member. This latent image is subsequently developed into a visible image by a process in which charged developing material is deposited onto the surface of the latent image bearing member, wherein charged particles in the developing material are attracted to and adhere to image areas of the latent image. The developing material may be in the form of a powder or liquid, where powder developing material typically comprises carrier granules having marking or toner particles adhering triboelectrically thereto, and liquid developing material (so-called liquid toner) typically comprises a carrier liquid having pigmented marking particles (or so-called toner solids) and optional charge director materials dispersed and/or dissolved therein. Regardless of the type of developing material utilized, in this typical process, the toner or marking particles of the developing material are uniformly charged and electrostatically or electrophoretically attracted to the latent image to form a visible developed image corresponding to the latent image on the imaging member. This developed image is subsequently transferred, either directly or indirectly, from the imaging member to a copy substrate, such as paper or the like, to produce a "hard copy" output document. In a final step, the imaging member is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as digital printing of electronically generated or digitally stored images, where the electrostatic latent image is formed via a modulated laser beam. Analogous processes also exist in other electrostatic printing applications such as, for example, ionographic printing and reproduction where charge is directly deposited in image-wise configuration on a dielectric charge retentive surface (see, for example, U.S. Pat. Nos. 4,267,556 and 4,885,220, among numerous other patents and publications), as well as other electrostatic printing systems wherein a charge carrying medium is adapted to carry an electrostatic latent image.

As described hereinabove, the typical electrostatographic process includes a development step whereby developing material including marking or toner particles are physically transported into contact with the imaging member so as to selectively adhere to the latent image areas thereon in an image-wise configuration. Development of the latent image is usually accomplished by electrical attraction of toner or marking particles to the image areas of the latent image. The development process is most effectively accomplished when the particles carry electrical charges opposite in polarity to the latent image charges, with the amount of toner or marking particles attracted to the latent image being proportional to the electrical field associated with the image areas. Some electrostatic imaging systems operate in a manner wherein charged areas in the latent image attract developer material (so-called charged area development (CAD), or "write white" systems), while other printing processes operate in a manner such that discharged areas attract developing material (so-called discharged area development (DAD), or "write black" systems).

In general, the present invention contemplates an electrostatographic imaging apparatus, wherein the electrostatic latent image is formed directly in a layer of developing material as opposed to on an imaging member. In a simple embodiment, the invention can be defined as an image development apparatus, comprising a system for generating an electrostatic latent image in a layer of developing material, wherein the electrostatic latent image in the developing material layer includes image and non-image areas having distinguishable charge potentials The latent image formed in the layer of developing material is subsequently developed into a visible image by selectively separating portions of the latent image bearing layer of developing material in accordance with the latent image imbedded therein.

In a more specific embodiment of the present invention, a novel electrostatographic imaging process is contemplated, wherein a layer of marking material or toner particles is selectively charged in an image-wise manner by directing charge species into a layer of developing material in an image-wise fashion. The process of directing charge species into the developing material layer in an image-wise fashion may be accomplished by means of any selectively controllable charging apparatus of the type well known in the art of ionography such as a device capable of generating a focused ion stream or producing controlled generation of plasma discharges, ions or electrons. Thus, the present invention contemplates the use of a selectively controllable charging apparatus whereby charges or charge species are selectively and directly applied to a layer of marking material or toner particles. These charges or charge species, in turn, are captured by the marking material or toner particles, leading to image-wise charging of the marking material or toner particles with the layer of marking material or toner particles itself becoming a latent image carrier. The latent image carrying toner layer is subsequently developed by selectively separating and transferring image areas of the toner layer directly or indirectly to a copy substrate for producing an output document.

As noted, selectively controllable charging apparatus or devices of the type contemplated for use in the present invention for directing charge species in an image-wise manner are well known in the art of electrostatic imaging and in particular ionography. Exemplary devices include conventional multiplexed matrix electrode arrays, as shown, for example, in U.S. Pat. Nos. 4,155,093, and 4,160,257, among numerous other patents and disclosures. Additional devices and apparatus known in the art which may be used to produce a focused charge stream may include: gated ion flow apparatus, targeted electrode corona generating devices, electron field emission sources combined with control electrode structures, and thin film devices. Exemplary patents which describe devices that may be incorporated into the practice of the present invention include: U.S. Pat. Nos. 5,315,324; 5,450,103; 5,617,129; and 5,655,184. The foregoing patents, as well as the relevant patents cited therein are hereby incorporated by reference into the present disclosure. It will be understood that various additional devices may be found in a great number of other patents and technical literature.

With respect to the general concept of the present invention, whereby a latent image is generated in a layer of developing material with the latent image bearing developing material layer being subsequently developed to form a visible image, it is noted that the following disclosures may be relevant to some aspects of the present invention:

U.S. Pat. No. 4,504,138

Patentee: Kuehnle et al.

Issued: Mar. 12, 1985

U.S. Pat. No. 5,387,760

Patentee: Miyazawa et al

Issued: Feb. 7, 1995

U.S. Pat. No. 5,436,706

Patentee: Landa et al.

Issued: Jul. 25, 1995

U.S. Pat. No. 5,619,313

Patentee: Domoto et al.

Issued: Apr. 8, 1997

U.S. patent application Ser. No. 08/883,292, now U.S. Pat. No. 5,826,147

Inventor: Liu et al.

Filed: Jun. 27, 1997

U.S. patent application Ser. No. 08/884,236

Inventor: Liu et al.

Filed: Jun. 27, 1997

The relevant portions of the foregoing patents may be briefly summarized as follows:

U.S. Pat. No. 4,504,138 discloses a method of developing a latent electrostatic charge image formed on a photoconductor surface comprising the steps of applying a thin viscous layer of electrically charged toner particles to an applicator roller preferably by electrically assisted separation thereof from a liquid toner suspension, defining a restricted passage between the applicator roller and the photoconductor surface which approximates the thickness of the viscous layer, and transferring the toner particles from the applicator roller at the photoconductor surface due to the preferential adherence thereof to the photoconductor surface under the dominant influence of the electric field strength of the electrostatic latent image carried by the photoconductive surface, the quantity of toner particles transferred being proportional to the relative incremental field strength of the latent electrostatic image. An apparatus for carrying out the method of the invention is also disclosed, which includes an applicator roller mounted for rotation in a container for toner suspension, an electrode arranged adjacent the circumferential surface of the roller to define an electrodeposition chamber therebetween and electrical connections between the roller, the electrode and a voltage source to enable electrolytic separation of toner particles in the chamber, forming a thin highly viscous layer of concentrated toner particles on the roller.

U.S. Pat. No. 5,387,760 discloses a wet development apparatus for use in a recording machine to develop a toner image corresponding to an electrostatic latent image on an electrostatic latent image carrier. The apparatus includes a development roller disposed in contact with or near the electrostatic latent image carrier and an application head for applying a uniform layer of the wet developer to the roller.

U.S. Pat. No. 5,436,706 discloses an imaging apparatus including a first member having a first surface having formed thereon a latent electrostatic image, wherein the latent electrostatic image includes image regions at a first voltage and background regions at a second voltage. A second member charged to a third voltage intermediate the first and second voltages is also provided, having a second surface adapted for resilient engagement with the first surface. A third member is provided, adapted for resilient contact with the second surface in a transfer region. The imaging apparatus also includes an apparatus for supplying liquid toner to the transfer region thereby forming on the second surface a thin layer of liquid toner containing a relatively high concentration of charged toner particles, as well as an apparatus for developing the latent image by selective transferring portions of the layer of liquid toner from the second surface to the first surface.

U.S. Pat. No. 5,619,313 discloses a method and apparatus for simultaneously developing and transferring a liquid toner image. The method includes the steps of moving a photoreceptor including a charge bearing surface having a first electrical potential, applying a uniform layer of charge having a second electrical potential onto the charge bearing surface, and image-wise dissipating charge from selected portions on the charge bearing surface to form a latent image electrostatically, such that the charge-dissipated portions of the charge bearing surface have the first electrical potential of the charge bearing surface. The method also includes the steps of moving an intermediate transfer member biased to a third electrical potential that lies between said first and said second potentials, into a nip forming relationship with the moving imaging member to form a process nip. The method further includes the step of introducing charged liquid toner having a fourth electrical potential into the process nip, such that the liquid toner sandwiched within the nip simultaneously develops image portions of the latent image onto the intermediate transfer member, and background portions of the latent image onto the charge bearing surface of the photoreceptor.

U.S. patent application Ser. No. 08/883,292, now U.S. Pat. No. 5,826,147, of common assignee, discloses a novel image development method and apparatus, wherein an imaging member having an imaging surface is provided with a layer of marking material thereon, and an electrostatic latent image is created in the layer of marking material. Image-wise charging of the layer of marking material is accomplished by means of a wide beam ion source such that free mobile ions are introduced in the vicinity of an electrostatic latent image associated with the imaging member having the layer of marking material coated thereon. The latent image associated with the imaging member causes the free mobile ions to flow in an image-wise ion stream corresponding to the latent image, which, in turn, leads to image-wise charging of the toner layer such that the toner layer itself becomes the latent image carrier. The latent image carrying toner layer is subsequently developed and transferred to a copy substrate to produce an output document.

U.S. patent application Ser. No. 08/884,236, of common assignee, discloses a novel image development method and apparatus, whereby image-wise charging of a toner layer is accomplished by induced air breakdown electrical discharge such that free mobile ions are introduced in the vicinity of an electrostatic latent image coated with a layer of developing material. The latent image causes the free mobile ions to flow in an image-wise ion stream corresponding to the latent image, which, in turn, leads to image-wise charging of the toner layer, such that the toner layer itself becomes the latent image carrier. The latent image carrying toner layer is subsequently developed and transferred to a copy substrate to produce an output document.

In accordance with one aspect of the present invention, there is provided an imaging apparatus, comprising: a support member including a support surface for supporting a layer of marking material; a marking material supply apparatus for depositing marking material on the surface of the support member to form the layer of marking material thereon; a charging source for selectively delivering charge species to the layer of marking material in an image-wise manner to form an electrostatic latent image in the layer of marking material, wherein the electrostatic latent image includes image areas defined by a first charge voltage and non-image areas defined by a second charge voltage distinguishable from the first charge voltage; and a separator member for selectively separating portions of the marking material layer in accordance with the latent image in the marking material layer to create a developed image.

In accordance with another aspect of the present invention, there is provided an imaging apparatus comprising means for image-wise charging of a toner layer by a charging source capable of producing controlled generation of plasma discharges, ions or other charge species in the vicinity of a layer of developing material, whereby the plasma discharge, ions or other charge species flow in an image-wise manner corresponding to a desired output image so as to produce a latent image in the toner layer. Means are also provided for developing the latent image carrying toner layer and transferring the developed toner layer to a copy substrate for producing an output document.

In accordance with another aspect of the present invention, an imaging apparatus, comprising a support member for having substantially uniform layer of developing material formed thereon is provided. The support member includes a surface capable of supporting a layer of marking material which may be in the form of toner particles. In addition, a charge source is provided for selectively delivering charges to the layer in an image-wise manner to form a latent image in the marking material layer having image and non-image areas defined by a first charge polarity and a second, distinguishable charge polarity. A separator member is also provided for selectively separating portions of the layer of marking material in accordance with the latent image in the layer of marking material to create a developed image corresponding to the electrostatic latent image formed in the layer of marking material.

In accordance with another aspect of the present invention, an imaging process is provided, comprising the steps of: depositing toner particles on a support surface to form a toner layer thereon; selectively delivering charges, ions or electrons to the toner layer in an image-wise manner for forming an electrostatic latent image in the toner having image and non-image areas, wherein the electrostatic latent image includes image areas defined by a first charge voltage and non-image areas defined by a second charge voltage distinguishable from the first charge voltage; and selectively separating and transferring portions of the layer of marking material from the support surface in accordance with the latent image therein for creating a developed image.

In accordance with another aspect of the present invention, an electrostatographic image development apparatus is provided, comprising: means for depositing a layer of marking particles on a support member; means for creating a selective electrical discharge in a vicinity of the layer of marking particles for selectively charging the layer so as to create an electrostatic latent image therein; and means for selectively separating portions of the marking material layer in accordance with the latent image for creating a developed image corresponding thereto.

In accordance with another aspect of the present invention, there is provided an image development apparatus, comprising a system for generating an electrostatic latent image in a toner layer, wherein the electrostatic latent image includes image and non-image areas having distinguishable charge potentials corresponding to image and non-image areas in an image to be developed.

In accordance with another aspect of the present invention, there is provided a process for image development, comprising the steps of generating an electrostatic latent image in the toner layer to form a toner layer having an embedded electrostatic latent image defined by image and non-image areas having distinguishable charge potentials corresponding to image areas.

In accordance with another aspect of the present invention, there is provided an image development apparatus, comprising means for image-wise charging of a toner layer by selectively introducing charge species in an image-wise stream corresponding to a desired output image in the vicinity of a layer of developing material, thereby creating an electrostatic latent image in the toner layer. Means are also provided for developing the latent image by selectively separating portions thereof and further transferring the developed image to a copy substrate for producing an output document.

In accordance with the yet another aspect of the present invention, an image development apparatus is described, comprising a surface having a layer of marking material thereon, and means for creating an electrostatic latent image in the layer of marking material. In addition, an image development process for developing an image is described, comprising the steps of providing a layer of marking material on a surface, and generating an electrostatic latent image in the layer of marking material.

These and other aspects of the present invention will become apparent from the following description in conjunction with the accompanying drawings in which:

FIG. 1 is a schematic elevational view depicting a system and process for image-wise toner layer charging and development in accordance with the present invention.

Figure 2:
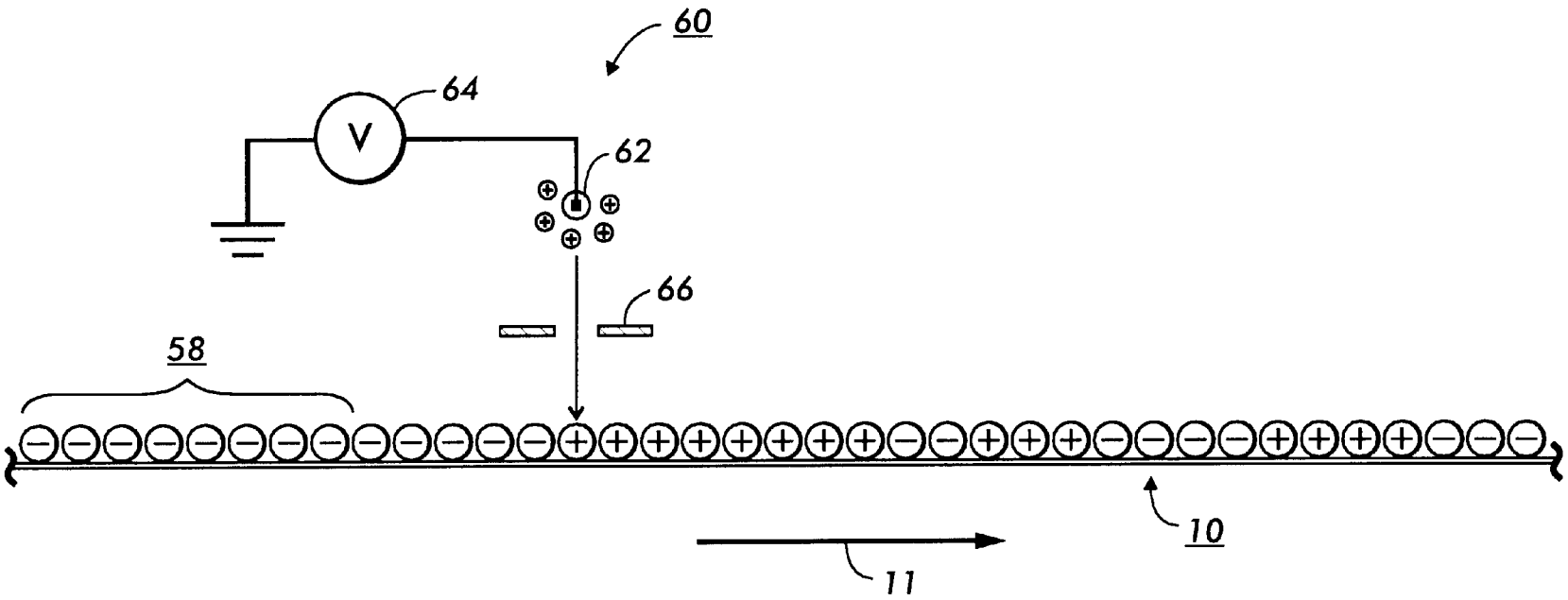
Figure 3:
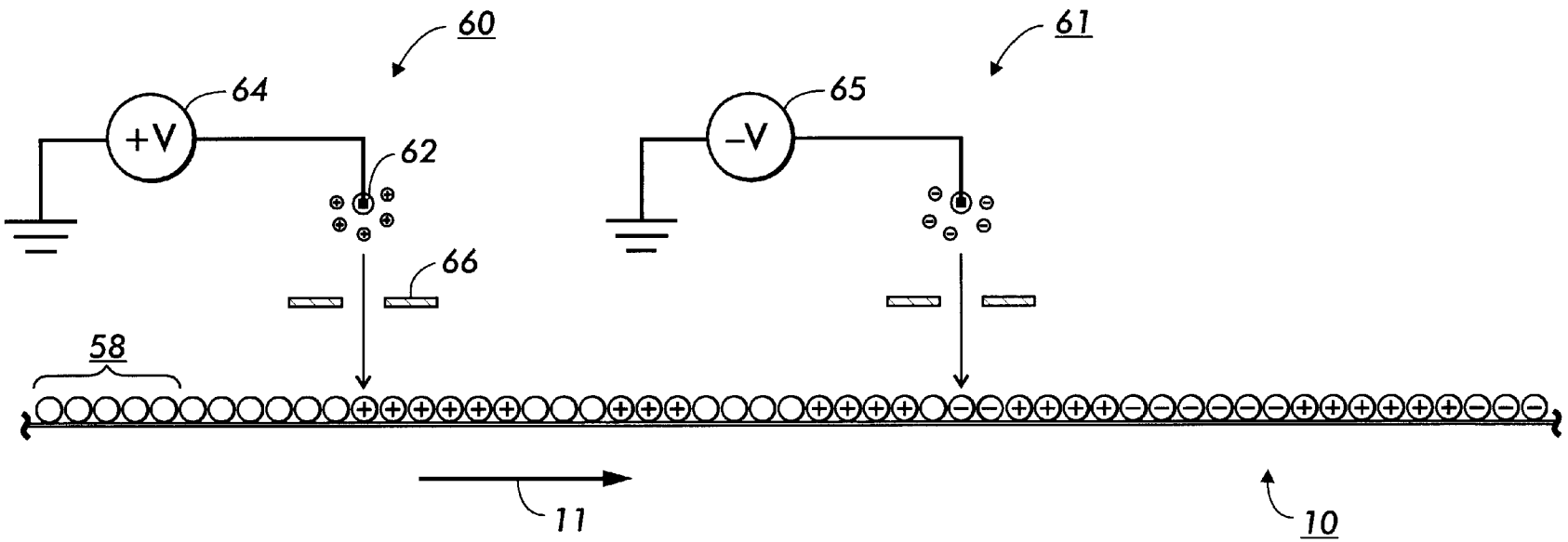
Figure 4:
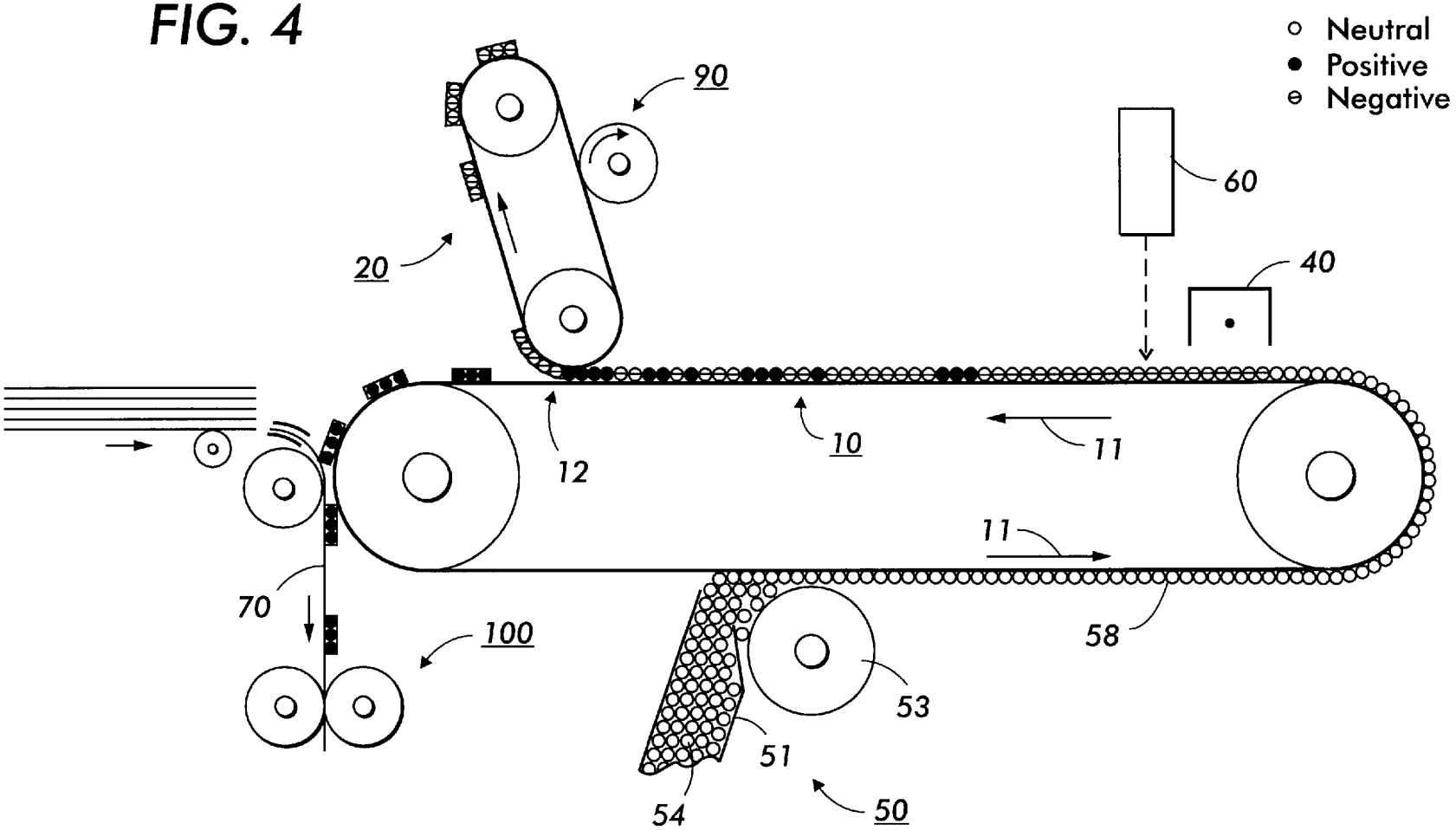
Figure 5:
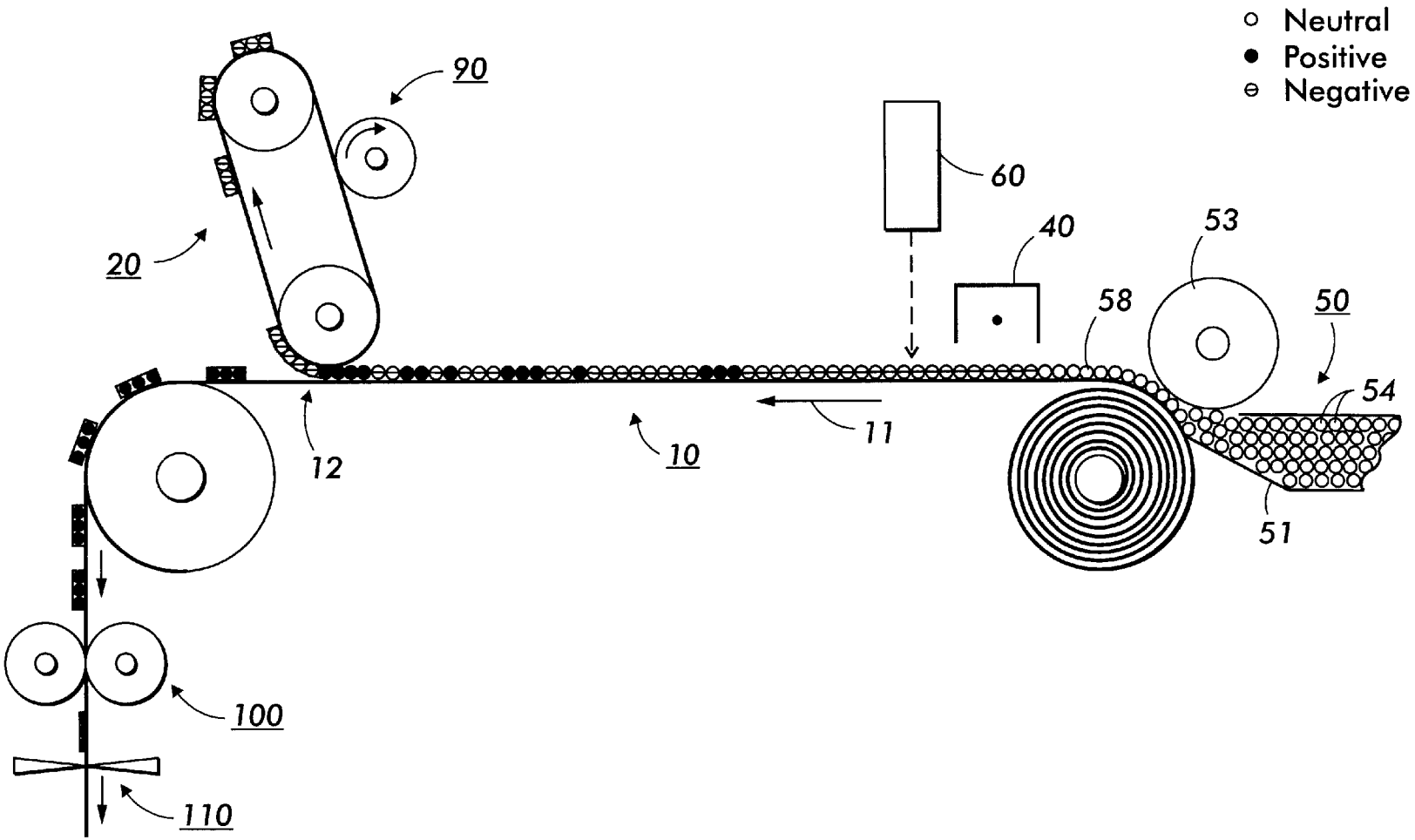

FIG. 2 is an exploded view illustrating image-wise charging of a toner layer by a selectively controllable charging device, wherein charge species in the form of ions are selectively delivered to a charged toner layer in accordance with a desired output image to reverse the charge thereon and to create a latent electrostatic image therein, as contemplated by one embodiment of the present invention;

FIG. 3 is another exploded view illustrating image-wise toner layer charging of a neutrally charged toner layer in a manner similar to that depicted in FIG. 2, as also contemplated by the present invention;

FIG. 4 is a schematic elevational view of an alternative embodiment for a system incorporating a belt-type imaging member and other variant subsystems to provide image-wise toner layer charging and selective separation of the image-wise charged toner layer to produce an output image in accordance with the present invention; and FIG. 5 is a schematic electrical view of another alternative embodiment for image-wise toner layer charging in accordance with the present invention, wherein the toner layer, latent image and output image are formed directly on the toner layer support member.

For a general understanding of the features of the present invention, reference is made to the drawings, wherein like reference numerals have been used throughout to identify identical or similar elements. Initially, a system and process for accomplishing image-wise toner layer charging and selective separation of the latent image bearing toner layer in accordance with the present invention will be described with reference to FIG. 1. While the present invention will be described in terms of an illustrative embodiment or embodiments, it will be understood that the invention is adaptable to a variety of copying and printing applications, such that the present invention is not necessarily limited to the particular embodiment or embodiments shown and described herein. On the contrary, the following description is intended to cover all alternatives, modifications, and equivalents, as may be included within the spirit and scope of the invention as defined by the appended claims.

Moving now to FIG. 1, an exemplary imaging apparatus capable of image-wise toner charging in accordance with the present invention is shown, comprising an assemblage of operatively associated image forming elements, including a toner layer support member 10 situated in contact with an image separating member 20 at an image separating nip 12 formed therebetween. Toner layer support member 10 includes a surface of any type capable of having a layer of developing material, either powder or liquid, formed thereon. An exemplary toner layer support member 10 may include a relatively thin surface layer 14 comprising a conductive material, an insulative material, a thin dielectric material of the type known to those of skill in the art of ionography, a semi-conductive material, or any other material which may be contemplated for use in a typical electrostatographic imaging system or otherwise. The surface layer 14 may be supported on an electrically conductive and preferably grounded support substrate 16. The toner layer support member 10 is rotated, as indicated by arrow 11, so as to transport the surface thereof in a process direction for implementing a series of image forming steps in accordance with the present invention. It will be understood that the present invention contemplates the use of various alternative embodiments for the toner layer support member which may include imaging members that are well known in the art of electrostatographic printing, including, for example, but not limited to, dielectric charge retaining member of the type generally used in ionographic printing machines.

As previously noted, a typical electrostatographic printing process involves the generation of an electrostatic latent image on the surface of an imaging member, and the subsequent step of selectively attracting marking particles in the form of charged toner particles to image areas of the electrostatic latent image. By contrast, in the present invention, a substantially uniform layer of charged or uncharged marking or toner particles is deposited on the entire surface of a toner layer support member 10. To that end, a toner supply apparatus or applicator 50 is provided, as depicted in the exemplary embodiment of FIG. 1, whereby charged or uncharged marking or toner particles (and possibly some carrier mechanism such as a liquid solvent) are transported onto the surface of the toner layer support member 10 to form a layer 58 thereon. The exemplary embodiment of FIG. 1 shows an illustrative toner applicator 50, wherein a housing 52 is adapted to accommodate a supply of toner particles 54 and any additional carrier material, if necessary. In an exemplary embodiment, the toner applicator 50 includes an applicator roller 56 which is rotated in a direction as indicated by arrow 57 to transport toner from housing 52 into contact with the surface of the imaging member 10, forming a substantially uniformly distributed layer of toner, or a so-called "toner cake", 58 thereon.

The toner cake 58 can be created in various ways. The toner cake 58 may be made up of charged or uncharged toner particles. In the case of a toner cake made up of charged toner particles, the charge can be placed on the toner particles while in the housing 52, for example via ionic charge additives. Alternatively, the charge can be placed on the toner particles in the toner cake 58 by means of any known ionic charging device, such as a well-known corona generating device, as depicted at element 40 of FIG. 4, as will be discussed.

Depending on the materials utilized in the printing process, as well as other process parameters such as process speed and the like, the layer of toner particles having sufficient thickness, preferably on the order of between 2 and 15 microns and more preferably between 3 and 8 microns, may be formed on the surface of the toner layer support member 10 by merely providing adequate proximity and/or contact pressure between the applicator roller 56 and the toner layer support member 10. Alternatively, in the case where the developing material comprises charged particles, electrical biasing may be employed to assist in actively moving the toner particles onto the surface of the toner layer support member 10. Thus, in one exemplary embodiment, the applicator roller 56 can be coupled to an electrical biasing source 55 for implementing a so-called forward biasing scheme, wherein the toner applicator 56 is provided with an electrical bias of sufficient magnitude to create electrical fields extending from the toner applicator roll 56 to the surface of the toner layer support member 10. These electrical fields cause toner particles to be transported to the surface of the toner layer member 10 for forming a substantially uniform layer of toner particles thereon.

It will be understood that various other devices or apparatus may be utilized for applying toner layer 58 to the surface of the toner layer support member 10, including various well known apparatus analogous to development devices used in conventional electrostatographic applications, such as, but not limited to: powder cloud systems which transport developing material through a gaseous medium such as air; brush systems which transport developing material to the toner layer support member by means of a brush or similar member; and cascade systems which transport developing material to the toner layer support member by means of a system for pouring or cascading the toner particles onto the surface of the toner layer support member. In addition, various systems directed toward the transportation of liquid developing material having toner particles immersed in a carrier liquid can be incorporated into the present invention. Examples of such liquid transport system can include a fountain-type device as disclosed generally in commonly assigned U.S. Pat. No. 5,519,473 (incorporated by reference herein), or any other system capable of causing the flow and transport of liquid developing material, including toner particles immersed in a liquid carrier medium, onto the surface of the imaging member. It is noted that, in the case of liquid developing materials, it is desirable that the toner cake formed on the surface of the toner layer support member 10 may be comprised of less than 10% by weight toner solids, and preferably in the range of 15%–35% by weight toner solids.

With respect to the foregoing toner cake formation process and various apparatus therefor, it will be understood that the toner layer generated on the imaging member surface can be characterized as having a substantially uniform mass density per unit area on the surface of the toner layer support member 10. However, it is noted that some toner layer nonuniformity may be generated such that it is not a requirement of the present invention that the toner layer be uniform or even substantially uniformly distributed on the surface of the toner layer support member 10, so long as the toner layer covers, at a minimum, the desired image areas of the output image to be produced.

In accordance with the present invention, after the toner layer 58 is formed on the surface of the toner layer support member 10, the toner layer is selectively charged in an image-wise manner. Thus, as shown in the system of FIG. 1, a selectively controllable charging apparatus, illustrated schematically as device 60, is provided for producing an image-wise charge stream to direct ions, electrons or other charge species toward the layer of developing material 58 present on support member 10, as will be described. The image-wise charge stream causes the toner particles in layer 58 to become selectively charged in an image-wise manner for generating an electrostatic latent image in layer 58 made up of toner particles having distinguishable charge levels in image and non-image areas corresponding to the latent image.

The process of generating a latent image in the toner cake layer 58 will be described in greater detail with respect to FIG. 2, where an initially charged toner cake 58 is illustrated, for purposes of simplicity only, as a uniformly distributed layer of negatively charged toner particles having the thickness of a single toner particle. The toner cake 58 resides on the surface of the toner layer support member 10 which is being transported from left to right past a selectively controllable charging apparatus 60. As previously described, the primary function of the selectively controllable charging device 60 is to direct charge species toward the toner layer 58 on the toner layer support member 10. The charging device may be embodied as various known devices, including, but not limited to, any of the variously known charge imaging devices available in the art including various solid state controllable charge devices and electron or ion sources of the type associated with ionographic image writing processes.

In the embodiment shown in FIG. 2, the selectively controllable charging apparatus 60 is shown as comprising a corona generating electrode 62 in combination with a charge deposition control device 66, whereby the originally uniformly charged layer of toner particles 58 on toner layer support member 10 is charged in imagewise fashion by ions emitted from corona generative device 66. In the type of device depicted in FIG. 2, the corona generating electrode 62 is situated generally adjacent the toner layer support member 10, across the width thereof. The electrode 62 or so called coronode, is typically connected to a voltage source 64 capable of providing a relatively high voltage potential thereto for causing the air immediately surrounding the electrode to become ionized and generate ions thereabout, as represented by the plus signs in the vicinity of the coronode. Interposed between the electrode 62 and the surface of support member 10 is a charge deposition control device, generally indicated by reference numeral 66. The control device 66 includes a plurality of openings for selectively allowing the passage of ions generated by coronode 62 in the direction of support member 10 as the member moves in a process direction, indicated by arrow 11. The imagewise deposition of ions in the toner layer 58 on the moving support member 10 is caused by selective control of the apertures present in control device 66, either to permit or not permit the passage of ions therethrough in accordance with image data. Positive ions in the vicinity of negatively charged toner are attracted to the toner layer, and captured thereby. In this way the ions emitted from electrode 62 form the desired electrostatic latent image in toner layer 58 by coordination of the imagewise modulation of the ion flow through the openings in control device 66 with the motion of support member 10.

With respect to the process illustrated by FIG. 2, it will be seen that the function of the selectively controllable charge device 60 is to selectively reverse the charge present on the toner layer 58 in an image-wise manner. Selectively controllable charging apparatus of the type contemplated for use in the present invention for directing ions, electrons or other charge species in an image-wise manner are well known in the art of electrostatic imaging and, particularly, in the field ionography. Other exemplary devices may include conventional multiplexed matrix electrode arrays, gated ion flow devices, electron field emission sources, control electrode structures, and thin film devices, among numerous other apparatus which are known in the art or may become known in the future. In addition, although the foregoing process has been described with respect to a positive ion source and a negatively charged toner layer, it will be understood that the process can also be implemented using a negative ion source and a positively charged toner layer. Alternatively, the process of the present invention can also be implemented using an uncharged or neutral toner layer, as will be described in greater detail as the present description proceeds. In the case of a image-wise charging of a charged toner layer, the process of the present invention requires that charging source 60 provide a charge stream having a charge polarity opposite the toner layer charge polarity.

It will be noted that, in the above-described process, a charged toner layer is situated on a toner layer support surface, wherein the charged toner layer is selectively exposed to charged ions for selectively reversing the pre-existing charge of the toner layer. Since the toner layer is initially charged, fringe fields, or field lines extending between image and non-image regions of the latent image, can affect the uniformity of the charged toner cake 58. While the existence of these fringe fields may be advantageous if the fringe fields can be properly controlled, these fringe fields may manifest themselves as image quality defects in the final output document. The present invention contemplates an alternative embodiment to the image-wise toner layer charging process described hereinabove, wherein the fringe field effect may be eliminated. This process is illustrated diagramatically in FIG. 3, wherein the original toner layer 58 being transported past the selective charging source is depicted with no charge. Thus, in an alternative embodiment of the present invention, the image-wise toner charging process of the present invention may be carried out using a neutrally charged toner cake 58 coated on the toner layer support member 10. In this case, the selectively controllable charging source 60, or multiple ion sources 60 and 61, as shown, are provided for presenting both negative and positive polarity charge species to the toner layer for oppositely charging regions of the toner layer 58 in accordance with image and non image areas of the latent image. In an exemplary embodiment, as illustrated in FIG. 3, a combination of two independent selectively controllable charging sources capable of providing opposite polarity charging species can be used. Optionally, alternative charge generating devices may be incorporated, either as a single AC driven device capable of providing both positive and negative charge ions.

In the exemplary embodiment of FIG. 3, the selectively controllable charge sources 60 and 61 are each independently driven by DC biasing sources 64 and 65, respectively, to provide opposite polarity charge streams. This embodiment operates in a manner similar to the embodiment of FIG. 2, wherein positive ions generated by charge source 60 are directed to the toner layer support 10 and captured by the neutrally charged toner layer 58 to define image areas of the latent image in the toner layer. Conversely, negative ions generated by charge source 61 are absorbed or captured by the remaining neutral toner particles in the toner layer 58 to define either non-image areas of the latent image in the toner layer. It will be understood that this process can be reversed such that charging device 60 defines non-image areas and charging device 61 defines image areas. Thus, the ions generated by ion sources 60 and/or 61 are selectively directed toward the toner layer 58 in accordance with the image and non-image areas of the desired output. This process induces image-wise charging of the toner layer 58, creating a latent image within toner layer 58 made up of image and non-image or background areas which are charged oppositely with respect to one another. Alternatively, but not necessarily preferably, a single charge device can be utilized to define either image or non-image areas as charged particles with the remaining image or non-image areas being defined by neutral charged particles. It is noted that such neutral charged particles may tend to adhere to the toner cake image on non-image areas on the toner layer support member 10, such that the dual charging embodiment depicted in FIG. 3 may be preferable for practicing the image-wise toner layer charging process of the present invention with respect to a neutrally charged toner cake.

Once the latent image is formed in toner layer 58, the latent image bearing toner layer is advanced to the image separator 20. Referring back to FIG. 1, image separator 20 may be provided in the form of a biased roll member having a surface adjacent to the surface of the toner layer support member 10 and preferably contacting the toner layer 58 residing on toner layer support member 10. An electrical biasing source is coupled to the image separator 20 for providing electrical bias to the image separator 20 for generating electrical fields in nip 12 so as to attract either image or non-image areas of the latent image formed in the toner layer 58 for simultaneously separating and developing the toner layer 58 into image and non-image portions. In the embodiment of FIG. 1, the image separator 20 is biased with a polarity opposite the charge polarity of the image areas in the toner layer 58 for attracting image areas therefrom, thereby producing a developed image made up of selectively separated and transferred portions of the toner cake on the surface of the image separator 20, while leaving background image byproduct on the surface of the toner layer support member 10. Alternatively, the image separator 20 can be provided with an electrical bias having a polarity appropriate for attracting non-image areas away from the toner layer support member 10, thereby maintaining toner portions corresponding to image areas on the surface of the support member 10, yielding a developed image thereon, while non-image or background areas are removed with the image separator 20.

After the developed image is created, either on the surface of the toner layer support member 10 or on the surface of the imaging separator 20, the developed image may then be transferred to a copy substrate 70 via any means known in the art, which may include an electrostatic transfer apparatus including a corona generating device of the type previously described or a biased transfer roll. Alternatively, a pressure transfer system may be employed which may include a heating and/or chemical application device for assisting in the pressure transfer and fixing of the developed image on the output copy substrate 70. In yet another alternative, image transfer can be accomplished via surface energy differentials wherein the surface energy between the image and the member supporting the image prior to transfer is lower than the surface energy between the image and the substrate 70, inducing transfer thereto. In a preferred embodiment, as shown in FIG. 1, the image is transferred to a copy substrate via a heated pressure roll 80, whereby pressure and heat are simultaneously applied to the image to simultaneously transfer and fuse the image to the copy substrate 70. It will be understood that separate transfer and fusing systems may be provided, wherein the fusing or so-called fixing system may operate using heat (by any means such as radiation, convection, conduction, induction, etc.), or other known fixation process which may include the introduction of a chemical fixing agent. Since the art of electrostatographic printing is well known, it is noted that several concepts for transfer and/or fusing which could be beneficially used in combination with the imagewise charging system of the present invention have been disclosed in the relevant patent literature.

In a final step in the process the background image byproduct residing on either the toner layer support member 10 or the image separator 20 is removed from the surface thereof in order to clean the surface in preparation for a subsequent imaging cycle. FIG. 1 illustrates a simple blade cleaning apparatus for scraping the imaging member surface as is well known in the art. Alternative embodiments may include a brush or roller member for removing toner from the surface on which it resides. In a preferred embodiment, the removed toner associated with the background image is transported to a toner sump or other reclaim vessel so that the waste toner particles can be recycled and used again to produce a toner cake in subsequent imaging cycles. Once again, it is noted that several concepts for cleaning and toner reclaim which could be beneficially used in combination with the image-wise charging system of the present invention have been disclosed in the relevant patent literature.

It will be understood that the apparatus and processes described hereinabove represent only a few of the numerous system variants that could be implemented in the practice of the present invention. One particular variant printing system incorporating the teaching of the present invention will be described with respect to FIG. 4, wherein toner layer support member 10 is provided in the form of a belt entrained about a pair of roll members including a drive roller driven by a conventional motor device (not shown) for advancing the belt in a process direction along a curvilinear path, thereby transporting the support member 10 through various processing stations disposed about the path of movement thereof.

In the embodiment of FIG. 4, a neutrally charged toner cake is deposited on an uncharged toner layer support member 10 via a toner supply apparatus 50 including a fountain-type applicator 51 in combination with a metering roll 53. Metering roll 53 includes a peripheral surface situated in close proximity to the surface of toner layer support member 10, preferably rotated in a direction opposite to the direction of movement of the toner layer support member 10, providing a shear force against the toner layer deposited on the surface of the toner layer support member, for controlling the thickness of the toner layer thereon. Thus, the metering roll 53 meters a predetermined amount of developing material (which may include toner particles immersed in liquid carrier). The excess material eventually falls away from the metering roll and may be transported to a sump for reuse in the toner applicator 51.

As previously noted, the neutrally charged toner layer deposited on the toner layer support member 10 may be uniformly charged prior to image-wise charging of the toner layer. To that end, the toner layer 58 is subsequently advanced to a charging station, shown to include a corona charging device 40. In this embodiment, the corona charging device 40 applies a charge to the neutrally charged toner layer 58 such that toner layer 58 will become charged. In this process, ions will be captured by the toner layer 58, generating a charge polarity therein, as illustrated by the negatively charged toner particles in FIG. 4.

The toner layer support member 10 now having charged toner layer 58 thereon, is next advanced to image charge station 60 which, selectively charges the charged toner layer 58 to create an electrostatic latent image thereon, as described in detail hereinabove. As a result of the foregoing process steps, a layer of charged toner particles is positioned on the surface of the toner layer support member 10 with an image-wise ion stream being generated in the presence of the toner layer 58 on the toner layer support member 10, as described in greater detail previously herein with respect to FIG. 2.

In the embodiment of FIG. 4, image separator 20 is also provided in the form of a belt member entrained about a pair of opposed rollers. The image separator 20 is preferably driven by contact engagement with the toner layer support member 10, although a drive device could also be coupled to one of the rollers for providing transport motion to the image separator belt. In this embodiment, electrical bias may be applied to the roll member adjacent the imaging member in a manner disclosed with respect to FIG. 1. Alternatively, electrical bias can be applied directly to the belt via a brush or well known commutator brush-type system. Such a commutator brush system may be desirable for permitting voltage variations in the nip 12 formed between the support member 10 and the image separator 20, thereby enabling a field tailoring approach at the transfer nip 12 similar to that disclosed in the prior art, as for example in commonly assigned U.S. Pat. Nos. 5,198,864 and 5,428,429, hereby incorporated by reference into the present patent application.

The embodiment of FIG. 4 contemplates that the image separator 20 is used to remove image background areas from the toner layer 58. Thus, the image separator 20 is biased so as to attract image background areas from the toner layer support member 10, thereby maintaining toner segments corresponding to image areas on the surface of the toner layer support member 10. Accordingly, the toner segments on image separator 20 are transported to a cleaning device 90, embodied as a roll member, while developed image areas remaining on the toner layer support member 10 are transported to a transfer station as typically found in a conventional electrostatographic printing machine. The toner segments making up the image are transferred to a copy substrate via any method which may be known in the art. The transferred image may thereafter be fused to the copy substrate at fusing station 100 and transported to an output device for retrieval by a machine operator.

Another particular variant printing system incorporating the teaching of the present invention is shown in FIG. 5, wherein toner layer support member 10 is provided in the form of a final support substrate such that the original toner layer, the latent image-bearing toner layer, and the output toner image are all formed thereon. In the illustrated embodiment of FIG. 5, the tone layer support member is provided in the form of a web comprising a coiled substrate material having the requisite conductive, semiconductive or dielectric properties necessary for carrying out the image-wise toner layer charging process of the present invention. Typical materials that might be utilized to form the web substrate may include dielectric or semi-conductive coated paper or conductive sheet material of the type that may be used to produce canned products.

The process steps described with respect to FIG. 4 are similar to those carried out with respect to FIG. 5, such that the process will not be described once again. The single difference in the process of FIG. 5 is that once the image is formed on support member 10, the support member is transported to a cutter station 110 for generating the desired output form having an image thereon. It will be understood that the process steps shown with respect to FIG. 5 can be varied in any manner consistant with the teachings of the present invention described herein to generate the desired output image.

In review, the present invention provides a novel image development method and apparatus, whereby image-wise charging is accomplished by a selectively controllable charging device such that charge species are selectively injected into a layer of developing material to generate an electrostatic latent image therein. An image-wise charge stream corresponding to the latent image leads to image-wise charging of the toner layer, such that the toner layer itself becomes the latent image carrier. The latent image carrying toner layer is subsequently developed and transferred to a copy substrate to produce an output document.

It is, therefore, evident that there has been provided, in accordance with the present invention an image-wise toner layer charging system for image development and transfer that fully satisfies the aspects of the invention hereinbefore set forth. While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. An imaging apparatus, comprising:

a support member including a support surface for supporting a layer of marking material;

a marking material supply apparatus for depositing marking material on the surface of said support member to form the layer of marking material thereon;

a charging source for selectively delivering charge species to the layer of marking material in an image-wise manner to form an electrostatic latent image in the layer of marking material, wherein the electrostatic latent image includes image areas defined by a first charge voltage and non-image areas defined by a second charge voltage distinguishable from the first charge voltage; and a separator member for selectively separating portions of the marking material layer in accordance with the latent image in the marking material layer to create a developed image.

2. The imaging apparatus of claim 1, wherein said support member includes a layer of dielectric material.

3. The imaging apparatus of claim 1, wherein said marking material supply apparatus is adapted to deposit a layer of uncharged marking particles on the surface of said support member.

4. The imaging apparatus of claim 1, wherein said marking material supply apparatus is adapted to deposit a layer of electrically charged marking particles on the surface of said support member.

5. The imaging apparatus of claim 1, wherein said marking material supply apparatus is adapted to deposit a marking material layer having a thickness of approximately 2 to 15 microns on the surface of said support member.

6. The imaging apparatus of claim 5, wherein said marking material supply apparatus deposits a marking material layer on the surface of said support member having a thickness in a range between approximately 3 and 8 microns.

7. The imaging apparatus of claim 1, wherein said marking material supply apparatus is adapted to accommodate liquid developing material including marking particles immersed in a liquid carrier medium.

8. The imaging apparatus of claim 7, wherein said marking material supply apparatus is adapted to deposit a marking material layer having a solids percentage by weight of at least approximately 10%.

9. The imaging apparatus of claim 7, wherein said marking material supply apparatus is adapted to deposit a marking material layer having a solids percentage by weight in a range between approximately 15% and 35%.

10. The imaging apparatus of claim 1, wherein said marking material supply apparatus is adapted to supply a marking material layer having a substantially uniform density onto the surface of the support member.

11. The imaging apparatus of claim 1, wherein said marking material supply apparatus includes:

a housing adapted to accommodate a supply of marking particles therein; and a rotatably mounted applicator roll member for transporting marking particles from said housing to the surface of said support member.

12. The imaging apparatus of claim 11, wherein said marking material supply apparatus further includes an electrical biasing source coupled to said applicator roll for applying an electrical bias thereto to generate electrical fields between said applicator roll and said support member so as to assist in forming the marking material layer on the surface of said support member.

13. The imaging apparatus of claim 1, wherein said marking material supply apparatus includes a fountain-type applicator assembly for transporting a flow of marking particles into contact with the surface of said support member.

14. The imaging apparatus of claim 13, wherein said marking material supply apparatus further includes a metering roll for applying a shear force to the marking material layer on the surface of said support member to control thickness thereof.

15. The imaging apparatus of claim 1, wherein said charging source is adapted for creating an image-wise charge stream directed toward the marking material layer on the support member.

16. The imaging apparatus of claim 15, wherein said charging source includes:

a corona generating electrode for emitting charge species having a predetermined charge polarity; and a charge deposition control device operatively interposed between said corona generating electrode and said support member having the layer of marking material thereon for directing charge species emitted from said corona generating electrode to the layer of marking material.

17. The imaging apparatus of claim 1, wherein said charging source includes a plurality of independent corona generating electrodes and associated charge deposition control devices.

18. The imaging apparatus of claim 17, wherein said plurality of independent corona generating electrodes includes:

a first corona generating electrode for providing charge species of a first charge polarity; and a second corona generating electrode for providing charge species of a second charge polarity.

19. The imaging apparatus of claim 1, wherein said separator member is adapted to attract marking material layer image areas associated with the latent image away from the support member so as to maintain marking material layer non-image areas associated with the latent image on the surface of the support member.

20. The imaging apparatus of claim 19, further including a cleaning apparatus for removing marking material layer non-image areas associated with the latent image from the surface of said support member.

21. The imaging apparatus of claim 1, wherein said separator member is adapted to attract marking material layer non-image areas associated with the latent image away from the support member so as to maintain marking material layer image areas associated with the latent image on the surface of the support member.

22. The imaging apparatus of claim 21, further including a cleaning apparatus for removing marking material layer non-image areas associated with the latent image from the surface of said separator member.

23. The imaging apparatus of claim 1, wherein said separator member includes a peripheral surface for contacting the marking material layer to selectively attract portions thereof away from the support member.

24. The imaging apparatus of claim 23, wherein said separator member includes an electrical biasing source coupled to said peripheral surface for electrically attracting selectively charged portions of the marking material layer.

25. The imaging apparatus of claim 1, further including a transfer system for transferring the developed image to a copy substrate to produce an output copy thereof.

26. The imaging apparatus of claim 25, wherein said transfer system includes a system for substantially simultaneously fixing the developed image to the copy substrate.

27. The imaging apparatus of claim 25, further including a fusing system for fusing the transferred image to the copy substrate.

28. An imaging process, comprising the steps of:

depositing toner particles on a support member to form a toner layer thereon;

selectively delivering charges to the toner layer on said support member in an image-wise manner for forming an electrostatic latent image in the toner layer having image areas defined by a first charge voltage and non-image areas defined by a second charge voltage distinguishable from the first charge voltage; and selectively separating portions of the toner layer from the support member in accordance with the latent image in the toner layer for creating a developed image.

29. The imaging process of claim 28, wherein said toner depositing step includes depositing a layer of uncharged toner particles on the surface of the support member.

30. The imaging process of claim 28, wherein said toner depositing step includes depositing a layer of charged toner particles on the surface of the support member.

31. The imaging process of claim 30, wherein said toner depositing step is adapted to deposit a toner layer having a substantially uniform density onto the surface of the support member.

32. The imaging process of claim 30, wherein said step of selectively delivering charges to the toner layer is adapted for creating an image-wise charge stream directed toward the toner layer on the support member.

33. The imaging process of claim 32, wherein said step of selectively delivering charges to the toner layer is adapted to generate charge species having a single charge polarity in the vicinity of the support member having the toner layer supported thereon.

34. The imaging process of claim 32, wherein said step of selectively delivering charges to the toner layer is adapted to generate charge species having first and second charge polarities in the vicinity of the support member having the toner layer supported thereon.

35. The imaging process of claim 34, wherein said step of selectively delivering charges to the toner layer includes a first step for generating charge species having a first charge polarity in the vicinity of the support member having the toner layer supported thereon; and a second step for generating charge species having a second charge polarity in the vicinity of the support member having the toner layer supported thereon.

36. The imaging process of claim 28, wherein said toner depositing step includes forming a toner layer having a thickness of approximately 2 to 15 microns on the surface of said support member.

37. The imaging process of claim 36, wherein said toner depositing step includes forming a toner layer having a thickness in a range between approximately 3 and 8 microns on the surface of the support member.

38. The imaging process of claim 28, wherein said toner depositing step includes depositing liquid developing material including toner particles immersed in a liquid carrier medium.

39. The imaging process of claim 38, wherein said toner depositing step is adapted to deposit a toner layer having a toner solids percentage by weight of at least approximately 10%.

40. The imaging process of claim 39, wherein said toner depositing step is adapted to deposit a toner layer having a toner solids percentage by weight in a range between approximately 15% and 35%.

41. The imaging process of claim 28, wherein said step of selectively separating portions of the toner layer from the support member includes the step of attracting toner layer image areas associated with the latent image away from the support member so as to maintain toner layer non-image areas associated with the latent image on the surface of the support member.

42. The imaging process of claim 28, wherein said step of selectively separating portions of the toner layer from the support member includes the step of attracting toner layer non-image areas associated with the latent image away from the support member so as to maintain toner layer image areas associated with the latent image on the surface of the support member.

43. The imaging process of claim 28, wherein said step of selectively separating portions of the toner layer from the support member includes providing a member having a peripheral surface for contacting the toner layer to selectively attract portions thereof away from the support member.

44. The imaging process of claim 43, wherein said step of selectively separating portions of the toner layer from the support member further includes providing an electrical bias to the member having a peripheral surface for contacting the toner layer to electrically attract selectively charged portions of the toner layer away from the support member.

45. The imaging process of claim 28, further including a transfer step for transferring the developed image to a copy substrate to produce an output copy thereof.

46. The imaging process of claim 45, wherein said transfer step further includes the step of substantially simultaneously fixing the developed image to the copy substrate.

47. The imaging process of claim 45, further including a fusing step for fusing the transferred image to the copy substrate.

48. The imaging process of claim 45, further including a cleaning step for removing toner layer non-image areas associated with the latent image from the surface of said support member.

49. The imaging process of claim 45, further including a cleaning step for removing toner layer non-image areas associated with the latent image from a surface of a separator member.

50. An electrostatographic image development apparatus, comprising:

means for depositing a layer of marking particles on a support member;

means for creating a selective electrical discharge in a vicinity of the layer of marking particles on the support member to selectively charge the layer of marking particles so as to create an electrostatic latent image in the layer of marking particles; and means for selectively separating portions of the layer of marking particles in accordance with the electrostatic latent image for creating a developed image corresponding to the electrostatic latent image formed in the layer of marking particles.

51. The electrostatographic image development apparatus of claim 50, wherein the layer of marking particles deposited on the support member includes uncharged toner particles.

52. The electrostatographic image development apparatus of claim 50, wherein the layer of marking particles deposited on the support member includes electrically charged toner particles.

53. The electrostatographic image development apparatus of claim 50, wherein the layer of marking particles on the support member has a thickness of approximately 2 to 15 microns.

54. The electrostatographic image development apparatus of claim 50, wherein the layer of marking particles on the support member has a thickness in a range between approximately 3 and 8 microns.

55. The electrostatographic image development apparatus of claim 50, wherein the layer of marking particles on the support member comprises liquid developing material including toner particles immersed in a liquid carrier medium.

56. The electrostatographic image development apparatus of claim 55, wherein the liquid developing material includes a toner solids percentage by weight of at least approximately 10%.

57. The electrostatographic image development apparatus of claim 56, wherein the liquid developing material includes a toner solids percentage by weight in a range between approximately 15% and 35%.

58. The image development apparatus of claim 50, wherein the layer of marking particles on the support member has a substantially uniform thickness.

59. The electrostatographic image development apparatus of claim 50, wherein said means for creating an electrical discharge provides charge species proximate to the support member having the toner layer supported thereon for creating an image-wise charge stream directed toward the toner layer on the support member.

60. The electrostatographic image development apparatus of claim 59, wherein said means for creating an electrical discharge includes means for creating an imagewise charge stream having a single charge polarity.

61. The electrostatographic image development apparatus of claim 60, wherein said means for creating an image-wise charge stream includes:

corona generating means for emitting charged ions; and charge deposition control means for selectively directing the charged ions toward the toner layer to be captured thereby.

62. The electrostatographic image development apparatus of claim 61, wherein said means for creating an electrical discharge includes a plurality of independently biased corona generating means and associated charge deposition control means.

63. The electrostatographic image development apparatus of claim 62, wherein said plurality of independent corona generating means includes:

a first corona generating electrode for providing charge species of a first charge polarity; and a second corona generating electrode for providing charge species of a second charge polarity.

64. The electrostatographic image development apparatus of claim 50, wherein said selective separating means includes a peripheral surface for contacting the layer of marking particles to selectively attract portions thereof away from the support member.

65. The electrostatographic image development apparatus of claim 64, wherein said selective separating means removes image areas of the latent image in the layer of marking particles so as to maintain non-image areas of the latent image in the layer of marking particles on the surface of the support member.

66. The electrostatographic image development apparatus of claim 50, wherein said selective separating means removes non-image areas of the latent image in the layer of marking particles so as to maintain image areas of the latent image in the layer of marking particles on the surface of the support member.

67. An electrostatographic image development process, comprising the steps of:

depositing a layer of marking particles on a support member;

selectively charging the layer of marking particles for creating an electrostatic latent image in the layer of marking particles; and selectively separating portions of the layer of marking particles in accordance with the electrostatic latent image for creating a developed image.

68. The electrostatographic image development process of claim 67, wherein the layer of marking particles on the support member includes uncharged toner particles.

69. The electrostatographic image development process of claim 67, wherein the layer of marking particles on the support member includes electrically charged toner particles.

70. The electrostatographic image development process of claim 69, wherein said step of depositing a layer of marking particles on the support member includes the step of depositing a substantially uniform thickness layer of marking particles onto the support member.

71. The electrostatographic image development process of claim 69, wherein said selective charging step includes directing an image-wise charge stream to the support member having the layer of marking particles supported thereon such that charge species are captured in an image-wise manner by the layer of marking particles on the support member to create the latent image therein.

72. The electrostatographic image development process of claim 71, wherein said selective charging step includes creating an image-wise charge stream having a single charge polarity.

73. The electrostatographic image development process of claim 71, wherein said selective charging step is adapted to create a plurality of image-wise charge stream having first and second charge polarities.

74. The electrostatographic image development process of claim 67, wherein said selective separating step includes the step of removing image areas of the latent image form the layer of marking particles so as to maintain non-image areas of the latent image in the layer of marking particles on the surface of the support member.

75. The electrostatographic image development process of claim 67, wherein said selective separating step includes the step of removing non-image areas of the latent image in the layer of marking particles so as to maintain image areas of the latent image in the layer of marking particles on the surface of the support member.

76. An image development apparatus, comprising:

a system for generating an electrostatic latent image in a toner layer by means of a selectively controllable charging device, wherein the electrostatic latent image includes image and non-image areas having distinguishable charge potentials corresponding to image and non-image areas in an image to be developed.

77. A process for image development, comprising the step of selectively directing charge toward a toner layer for generating an electrostatic latent in the toner layer to form a toner layer having an embedded electrostatic latent image therein, defined by distinguishable charge potentials corresponding to image and non-image areas.

78. An electrostatographic image development apparatus, comprising:

a support member including a surface having a layer of marking material thereon; and means for embedding an electrostatic latent image in the layer of marking material.

79. An electrostatographic image development process for developing an image on a support member, comprising the steps of:

providing a layer of marking material on a surface of the support member; and embedding an electrostatic latent image in the layer of marking material.

* * * * *